United States Patent [19]

Grossman

[11] Patent Number: 4,896,819

[45] Date of Patent: Jan. 30, 1990

[54] FOLDABLE GIFT BASKET

[76] Inventor: John W. Grossman, 20 Park Dr., San Anselmo, Calif. 94960

[21] Appl. No.: 295,652

[22] Filed: Jan. 10, 1989

[51] Int. Cl.[4] ..... B65D 5/36; B65D 5/46

[52] U.S. Cl. ..... 229/8; 206/44 K; 229/110; 229/108.1

[58] Field of Search ..... 206/44 K; 229/110, 8, 229/41 C

[56] References Cited

U.S. PATENT DOCUMENTS

| | | | |
|---|---|---|---|
| D. 76,639 | 10/1928 | Schleicher | 229/8 |
| 1,485,144 | 3/1924 | Morgan | 229/8 |
| 2,048,089 | 7/1936 | Westfall | 229/8 X |
| 2,500,904 | 3/1950 | Nitsch | 229/8 X |
| 2,572,631 | 10/1951 | Kurhan | 206/44 K X |
| 2,741,416 | 4/1956 | Hileman | 229/41 C |
| 2,770,407 | 11/1956 | Dahm | 229/8 |
| 2,917,222 | 12/1959 | Frankenstein | 229/110 X |
| 3,101,167 | 8/1963 | Styler | 229/41 C |
| 3,174,675 | 3/1965 | Rosenburg | 229/41 C |
| 3,269,640 | 8/1966 | Arneson | 229/110 X |
| 4,146,169 | 3/1979 | Meyers et al. | 229/41 C |
| 4,264,031 | 4/1981 | Goebel | 229/110 X |
| 4,383,637 | 5/1983 | Pfieffer et al. | 229/110 |
| 4,736,885 | 4/1988 | Negus, Sr. | 229/110 |

FOREIGN PATENT DOCUMENTS

| | | | |
|---|---|---|---|
| 0788320 | 6/1968 | Canada | 229/8 |
| 0111070 | 12/1944 | Sweden | 229/8 |
| 1599051 | 9/1981 | United Kingdom | 229/41 D |
| 2099401 | 12/1982 | United Kingdom | 229/110 |

*Primary Examiner*—Stephen Marcus
*Assistant Examiner*—K. M. Stemann
*Attorney, Agent, or Firm*—Owen, Wickersham & Erickson

[57] ABSTRACT

A decorative, foldable cardboard basket for hand carrying and displaying selected items is disclosed. The basket comprises a central receptacle having connected side walls, end walls and a bottom section with linear fold lines in its end walls and bottom section that enable it to assume an essentially flattened configuration, and a bottom member for holding the receptacle in its opened, erect configuration. A pair of side panels of flexible material which may be provided with a distinctive design shape and graphics are attached to and extend above the side walls, each panel having an opening within an upper portion that forms a handle for the basket.

7 Claims, 3 Drawing Sheets

FIG._3
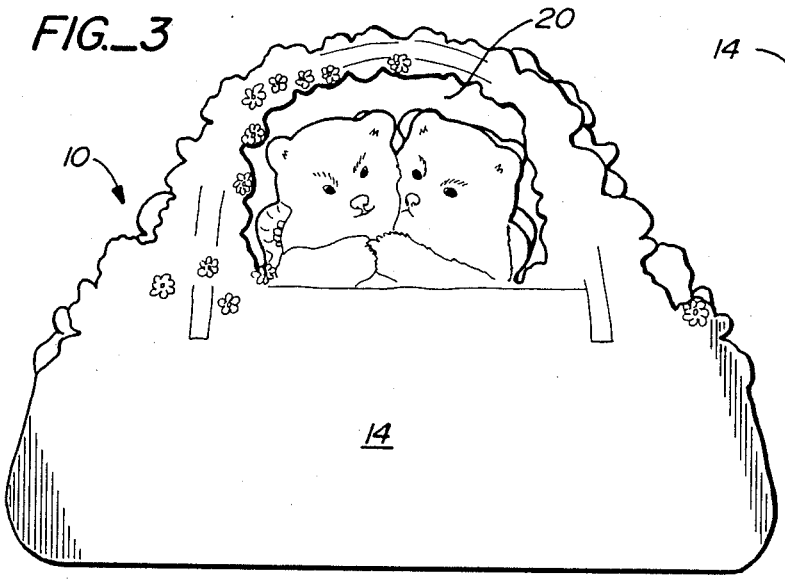
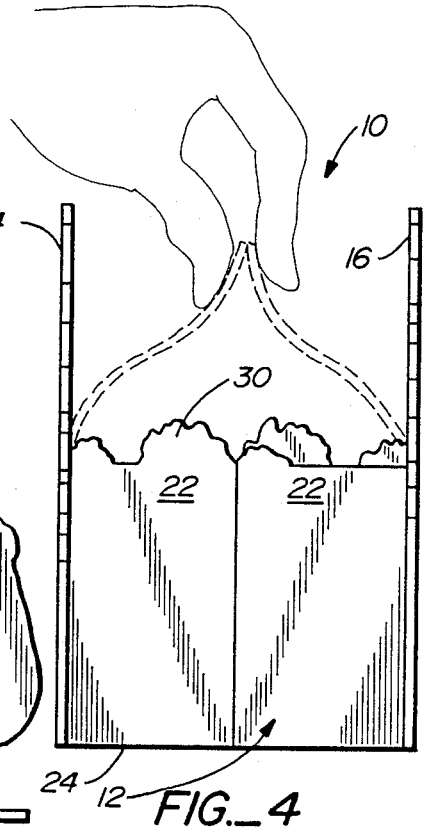
FIG._4
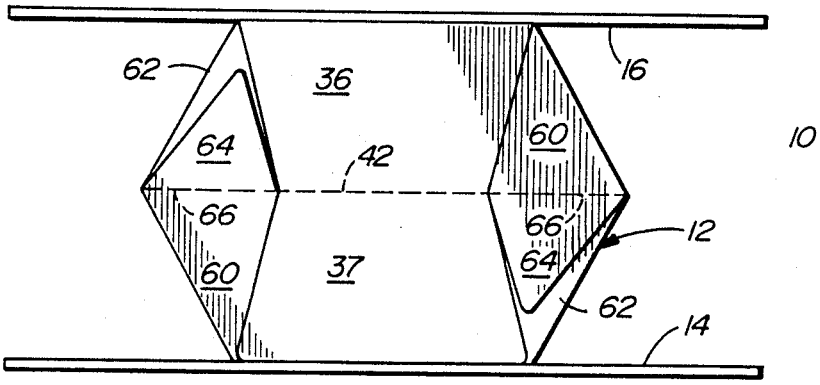
FIG._6
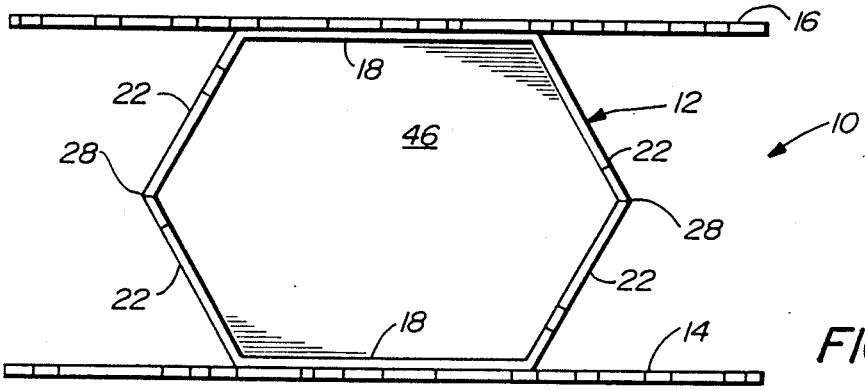
FIG._5

FOLDABLE GIFT BASKET

This invention relates to a foldable cardboard gift basket for carrying, displaying and packaging novelty gift items, and more particularly one that can be readily adorned with artistic and colorful graphics on its exterior surface.

BACKGROUND OF THE INVENTION

For many occasions it is desireable to provide a unique and colorful manner in which to carry, display or present various items for use as gifts or other purposes. Open baskets of different construction including woven wood strips or wicker material have long been used. In some instances paper or cardboard containers having an open top have been devised, but in most instances such containers were cumbersome in construction and lacked any artistic flair or novelty. Accordingly, a general object of this invention is to provide a unique cardboard basket construction which is not only well adapted for ease and economy of manufacture but is also particularly well suited to incorporate artistic graphics on its exterior surface thereby making such baskets highly desireable for gift displaying, packaging and presenting.

Another object of the invention is to provide a cardboard basket carrying small gifts or other items which is foldable into essentially a flat package when not in use.

Yet another object of the invention is to provide a cardboard gift basket with a central, foldable carrying receptacle having side walls in combination with a pair of decorative exterior panels attached to the side walls that extend above the carrying receptacle and are bendable together to form a handle means for the basket.

SUMMARY OF THE INVENTION

In accordance with the principles of the invention a basket is provided which is comprised of three die-cut parts. A first die-cut part is comprised of a plurality of panels and fold lines which when erected, will form an open receptacle having a bottom, opposite side walls and end walls and is suitable for carrying a wide variety of relatively small items. The second and third die-cut parts are planar panels of thin bendable cardboard each having a desired irregular shape and preferably printed on its outer surface with decorative graphics. These bendable panels are attached by suitable means to the receptacle side walls so that a substantial portion of each panel extends above the upper edges of the side walls. The basket can then be easily carried when the panels are held together at their upper ends. When not in use, or when shipped in quantity the center receptacle part of the basket is foldable into substantially a flat package requiring a minimum of space.

Other objects, advantages and features of the invention will become apparent from the following detailed description of one embodiment thereof taken in conjunction with the accompanying drawing.

BRIEF DESCRIPTION OF THE DRAWING

FIG. 3 is a view in side elevation of the basket shown in FIG. 1.

FIG. 4 is a view in end elevation of the basket shown in FIG. 1 with the flexed side panels shown in dotted lines as they appear when used as handles.

FIG. 5 is a top view of the basket according to the invention.

FIG. 6 is a bottom view of the basket according to the invention.

DETAILED DESCRIPTION OF EMBODIMENT

Figure 1:
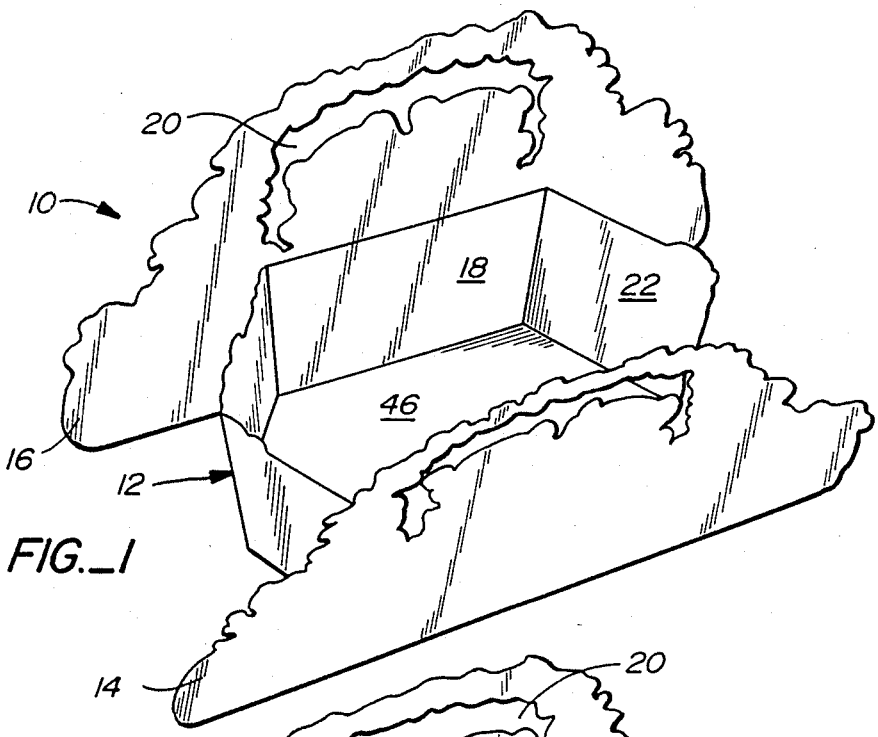
FIG. 1 is a view in perspective of a cardboard basket embodying principles of the present invention.
Figure 2:
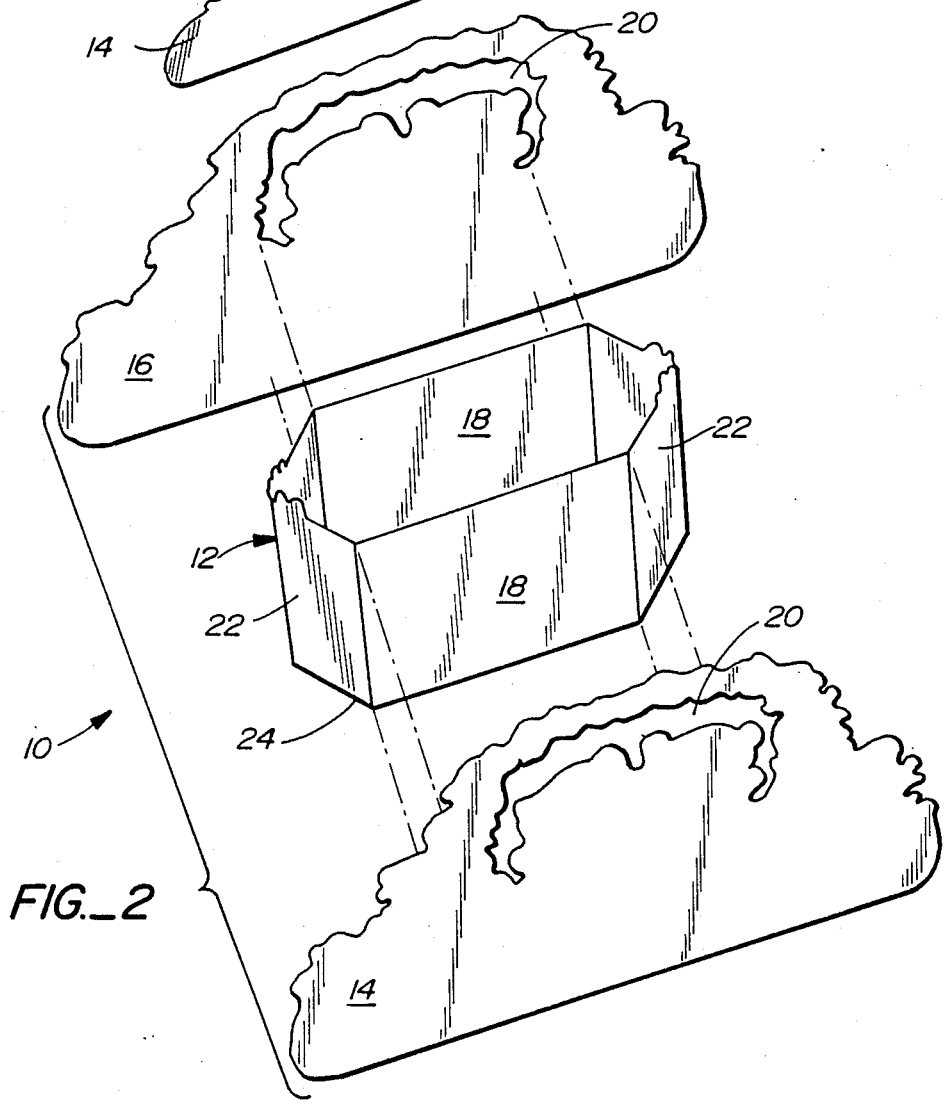
FIG. 2 is an exploded view in perspective of the basket shown in FIG. 1, with the decorative side panels detached.

With reference to the drawing, FIG. 1 shows one form of a cardboard basket 10 embodying principles of the present invention as it appears when fully erected to form a device for carrying or displaying small items such as wrapped gifts, candies or the like. In general, the basket is comprised of three components namely an open box-like central receptacle 12 and two decorative side panels 14 and 16 that are attached to opposite side walls 18 of the receptacle and also serve as handles for the basket. All three of these components are made from cardboard sheet stock of suitable thickness (e.g. 0.02–0.04 inches) to provide adequate strength and durability and preferably having an outer surface capable of accepting and retaining colored printing. As shown, the side panels are preferably die-cut to form a particular design along its periphery that is associated with the colored graphics on their outer surface. Whatever die-cut design is used, each side panel has an internal cut-out area 20 near its upper end (See FIG. 3). Thus, as shown in FIG. 4, when the basket is used, it may be carried with one hand by the side panels which are bent together to form handles. The lower side portion of each side panel is firmly attached to the outer surface of one side wall of the receptacle by a suitable adhesive.

Figure 7:
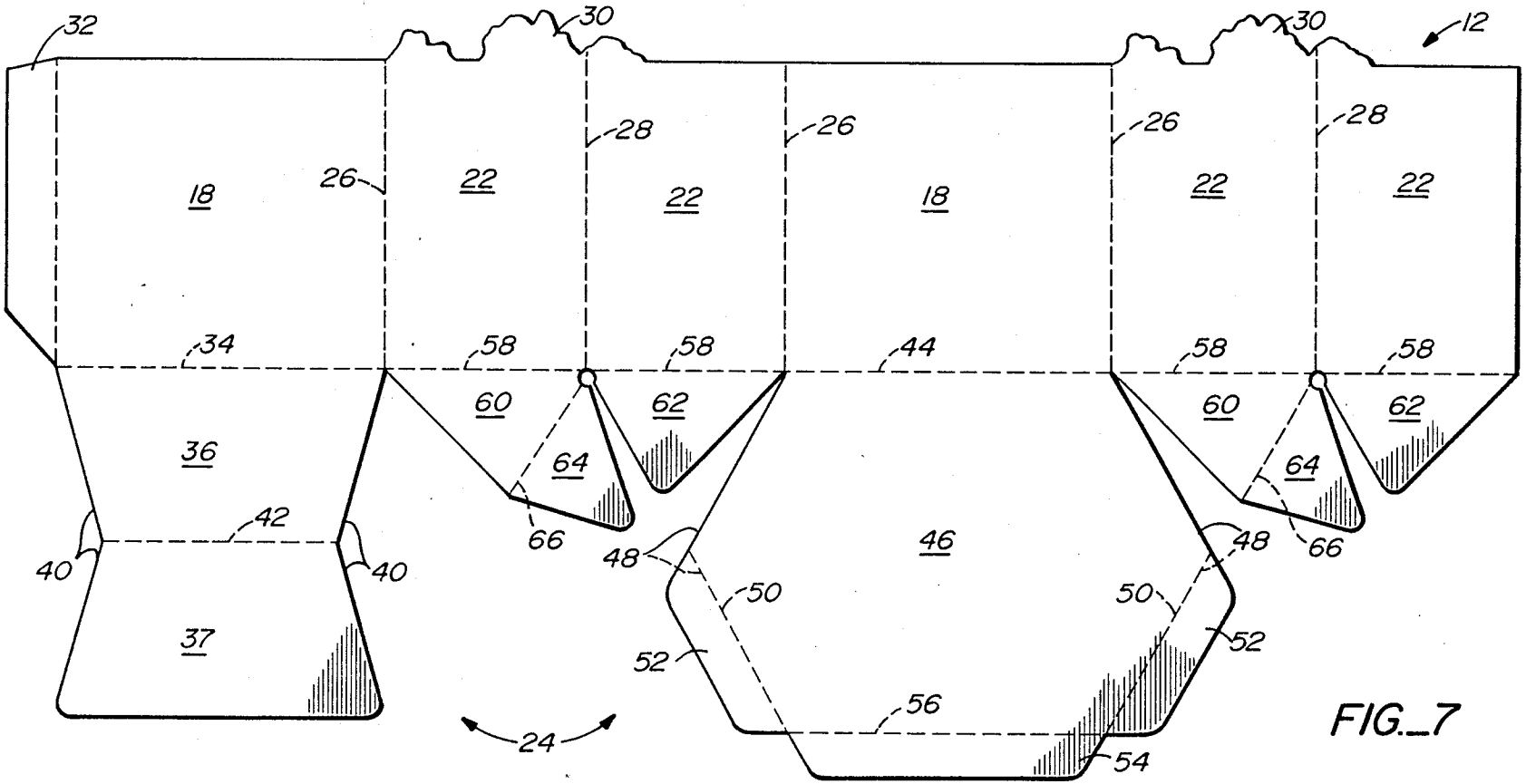
FIG. 7 is a flat pattern of the die-cut member that can be folded to form the central receptacle for the basket of FIGS. 1–6.

The central receptacle has a pair of end walls 22 connected to its side walls 18 and a bottom 24. The flat pattern for the central receptacle 12 is formed on a unitary die-cut sheet, as shown in FIG. 7. In the pattern shown, the two side walls 18 are essentially rectangular panels which are connected to adjacent end walls by three fold lines 26. Each end wall 22 is also generally rectangular but each has a fold line 28 that is midway between and parallel to its vertical side edges or the fold lines 26. Extending above the top edge of one or both end walls may be a die-cut extended portion 30 that is part of the exterior design graphics for the basket. On the outer edge of one side is a vertical tab member 32 that is used to hold the receptacle together. Attached to a fold line 34 along the bottom edge of one side wall 18 is an exterior bottom member that has two portions 36 and 37 with oppositely tapered outer edges 40 and separated by a fold line 42 that is parallel to the bottom edge of the adjoining side wall. Attached to a fold line 44 along the bottom edge of the other side wall 18 is an interior bottom panel member 46. This member has outer end edges 48 that taper to a point so that it will fit within the end walls of the receptacle. Along fold lines 50 forming two opposite outer edges of the panel member 46 are a pair of narrow tab members 52. A similar tab member 54 is provided along a fold line 56 that is parallel to the fold line 44 at the lower edge of the adjacent side wall panel. Attached by a fold line 58 to the bottom edge of each end member 22 are a pair of tab members 60 and 62 having a triangular shape which support the end member 22 and hold it in a predetermined angular position when the receptacle is erected.

Each tab member 60 has an extended tab portion 64 which is connected to it by a fold line 66.

After the central receptacle is die-cut and printed in the form shown in FIG. 7, it is formed into the receptacle 12 by the connection of certain panels and tabs using an adhesive. Thus, the tab member 32 is attached to inside edge surface of the end panel 22 at the opposite end of the pattern blank. Each tab portion 64 is bonded to the inside surface of the adjacent tab member 62. The inside surface of the exterior bottom panel 37 is bonded to the outer surface of the interior bottom member. When the aforesaid members are connected as described, the receptacle 12 will fold into a substantially flat package due to the fold lines 28 in the end walls 22, the fold lines 42 in the bottom member 36 and the fold lines 66 in the tab members 60 and 64.

In the folded position, the interior bottom member 46 is folded upwardly and parallel to the side walls 18. When the receptacle 12 is erected into its open position, the folded panels extend and the interior bottom panel 46 moves downwardly adjacent the exterior bottom panels as its tab members 52 and 54 hold the panel 46 against the inside surfaces of the opposite side wall and the end walls.

From the foregoing it is shown that the present invention provides a unique, highly useful and also decorative basket that can be easily erected and filled with desired items and then be conveniently carried by the upper handle portions of the side panels 14 and 16 which are fixed to the central receptacle 12. Since the side panels are simple die-cut sheets they can have many different shapes with a wide variety of external graphic designs or artwork that can also be continuous on the exterior of the end panels. Using known die-cutting and printing techniques, the baskets 10 according to the invention can thus take many forms and can yet be made at relatively low unit cost.

The above described preferred embodiments are intended to illustrate the principles of the invention, but not to limit the scope of the invention. Various other embodiments and modifications to these preferred embodiments may be made by those skilled in the art, without departing from the scope of the following claims.

What is claimed is:

1. A decorative, foldable cardboard basket for carrying and displaying selected items, comprising:

a central receptacle having connected side walls, end walls and a bottom section, said receptacle having linear fold lines in its end walls and bottom section to enable the receptacle to assume an essentially flattened configuration, and means for holding said receptacle in its opened, erect configuration; and a pair of side panels of flexible sheet material and having decorative printing on their outer surfaces, each said panel having an inner surface attached to and extending above the outer surface of one side wall and having an opening within an upper panel portion that forms a handle for said basket when said upper panel portions are bent together.

2. The basket as described in claim 1 wherein said central receptacle is formed as a simple die-cut sheet of cardboard having panels and fold lines that enable it to assume both the flattened and erect configuration.

3. The basket as described in claim 1 where said side panels are separate die-cut pieces of cardboard with an irregular exterior edge that is compatible with multi-colored printing on the exterior of said panels.

4. The basket as described in claim 1 wherein said receptacle has fold lines in both its end walls and in its bottom section to facilitate being folded into its flattened configuration.

5. The basket as described in claim 1 wherein the exterior surfaces of both side panels and said end walls are provided with multi-colored printing.

6. The basket as described in claim 1 wherein said bottom section comprises a pair of connected bottom portions hingedly connected to the bottom edge of one said side wall, and pairs of tab members hingedly connected to the bottom edge of said end walls and attached to said bottom portions.

7. The basket as described in claim 6 wherein said means for holding said receptacle in its opened, erect configuration comprises an interior bottom panel member which is movable to a position parallel with and adjacent to said bottom section.

* * * * *